United States Patent [19]

Baltensperger et al.

[11] 4,211,171

[45] Jul. 8, 1980

[54] STATION FOR SUSPENDED TRACK-TYPE RAILWAY

[76] Inventors: Rudolf Baltensperger, Kaiserstuhlstr. 157, CH-8181 Höri; Hans B. Pfister, Frohhaldenstr. 20, CH 8180 Bülach, both of Switzerland

[21] Appl. No.: 956,443

[22] Filed: Nov. 1, 1978

[30] Foreign Application Priority Data

Nov. 14, 1977 [CH] Switzerland ..... 13832/77

[51] Int. Cl.[2] ..... E01B 25/24

[52] U.S. Cl. ..... 104/123; 14/21

[58] Field of Search ..... 104/123, 125; 14/18, 14/19, 20, 21

[56] References Cited

U.S. PATENT DOCUMENTS

| | | | |
|---|---|---|---|
| 3,230,560 | 1/1966 | Finsterwalder | 14/18 |
| 3,604,361 | 9/1971 | Herbert et al. | 104/123 |
| 3,753,406 | 8/1973 | Müller | 104/123 |

FOREIGN PATENT DOCUMENTS

| | | | |
|---|---|---|---|
| 2723543 | 12/1978 | Fed. Rep. of Germany | 104/123 |
| 601560 | 7/1978 | Switzerland | 104/123 |

*Primary Examiner*—John J. Love
*Assistant Examiner*—Ross Weaver
*Attorney, Agent, or Firm*—Karl F. Ross

[57] ABSTRACT

A suspended railway has a fixed tower spaced horizontally from a fixed station. A suspension cable is slung between this tower and the station and a plurality of horizontally spaced upright hangers depending from this cable support a suspended section of a horizontally extending track also having a fixed section secured in the station. As a car travels along the track it vertically deflects the track from an upper unloaded position to a lower loaded position. A substantially rigid guide beam projects from the station between the track and the cable toward the tower and has a lower guide surface bearing downwardly on the track in the unloaded position thereof. Thus as the car approaches the fixed section of the track at the station the suspended section is pulled downwardly away from the guide beam.

10 Claims, 8 Drawing Figures

STATION FOR SUSPENDED TRACK-TYPE RAILWAY

FIELD OF THE INVENTION

The present invention relates to a station for a suspended track-type railway. More particularly this invention concerns the structure at such a station which is provided at the entry or exit for the suspended railway car.

BACKGROUND OF THE INVENTION

A suspended railway has at least one upper suspension cable supported at intervals at towers and following caternary paths between the towers each of which is provided at its top with an upwardly convex carrying saddle over which the suspension cable passes (see copending application Ser. No. 956,652). Suspended from this upper cable by means of a plurality of horizontally spaced upright hangers or suspenders (see copending application Ser. No. 956,654) of different length is one or more lower track cables that define a generally straight and noncaternary path which may be level or inclined. In a light-duty low-speed system a passenger or freight car has a bogey or truck that rides directly on the track cable.

In a heavy-duty system the track cable carries a rigid track (see copending application Ser. No. 956,442) on which the passenger or freight car rides (see German patent publication No. 1,905,686). Such a rigid track greatly decreases lateral sway, that is displacement of the track and car in a horizontal direction transverse of the direction of travel longitudinally along the cables, and permits heavy loads to be transported at high speeds.

Such a system is normally provided at each of the towers with at least one stressing or shaping beam (see copending application Ser. No. 906,854) which imparts to the track between the towers in the unloaded condition a negative curve, downward concavity, that is straightened out when these sections between the towers are loaded by a car traveling along the track (see German patent publication No. 2,149,871). The amount of vertical deflection at the tower is minimal, so that it is even possible to mount such a beam on the tower.

Stations must be provided along such a suspended railway for loading and unloading or diverting a car onto another track. Whether they are way stations through which the railway passes, terminal stations at which the transport path ends, or junction stations where three or more tracks meet, such stations are invariably supported fixedly relative to the ground and are provided with stationary guide and support structure for the cars which must be fully stationary during any loading, unloading, or switching from one track to another.

since the suspended section of the track moves vertically as the car moves along it, but the section of track fixed in the station does not, a considerable strain is effective on the track at the location where the suspended section merges with the fixed section. For high-speed operation it is, however, essential that the freight or passenger car be able to move smoothly and rapidly across this transition area.

OBJECTS OF THE INVENTION

It is an object of this invention to provide an improved station for a suspended track-type railway.

Another object is to provide such a station which is compatible with the suspended railway described in the commonly owned and copending application cited above, all of whose disclosures are herewith incorporated.

A yet further object is to provide station structure for such a suspended railway wherein the transition from the suspended and deflectable part of the track to the fixed part is gradual and uniform.

SUMMARY OF THE INVENTION

These objects are attained according to the present invention in a suspended railway of the above-described general type wherein a substantially rigid guide beam is provided which projects from the station between the suspended track and the suspension cable toward the closest tower, and has a lower guide surface bearing downwardly on the track in the unloaded position thereof. Thus as the car approaches the fixed section of the track at the station the suspended section is pulled down from the guide beam. At the same time the guide beam fulfills the function of the rounding or biasing beam normally provided at the tower so that in the unloaded condition the suspended or slung portion of the track has negative curvature, that is downward concavity.

According to further features of this invention the beam has one end fixed at the station and another end lying between the station and the nearest tower. This beam is formed between its two ends with at least one throughgoing hole through which may vertically extend a respective one of the hangers suspending the track from the caternary suspension cable.

In accordance with yet another feature of this invention means is provided for preventing horizontal shifting of the track in a direction perpendicular to its direction of elongation relative to the fixed guide beam. This means can be constituted by rollers operatively engaged between the track and the guide beam. Other means is provided for preventing excessive horizontal displacement of the track downwardly away from the guide beam. Such means will only enter into effect to prevent such displacement when the downward deflection exceeds a predetermined maximum safe level, but in normal operation the downward displacement of the track will be unhindered.

SPECIFIC DESCRIPTION

Figure 1:
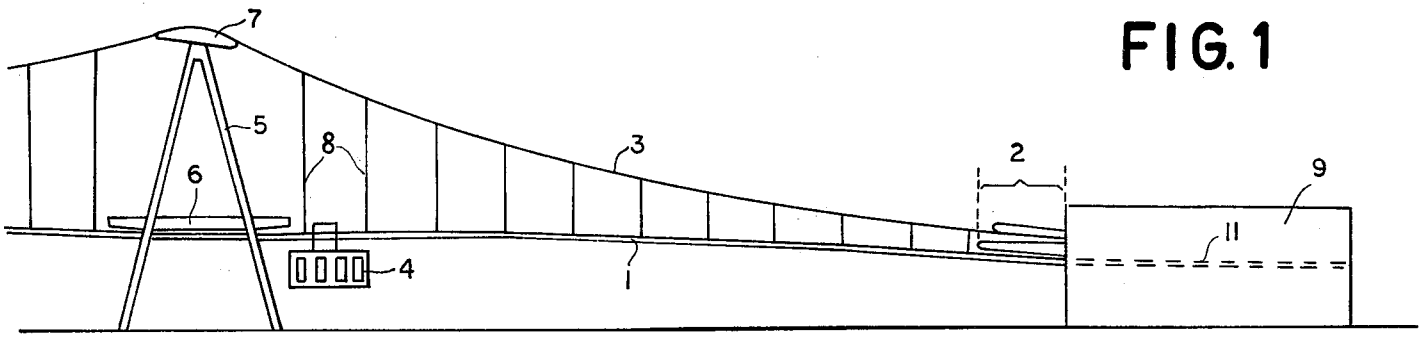
FIGS. 1 and 2 are side views of suspended railways according to this invention.
Figure 2:
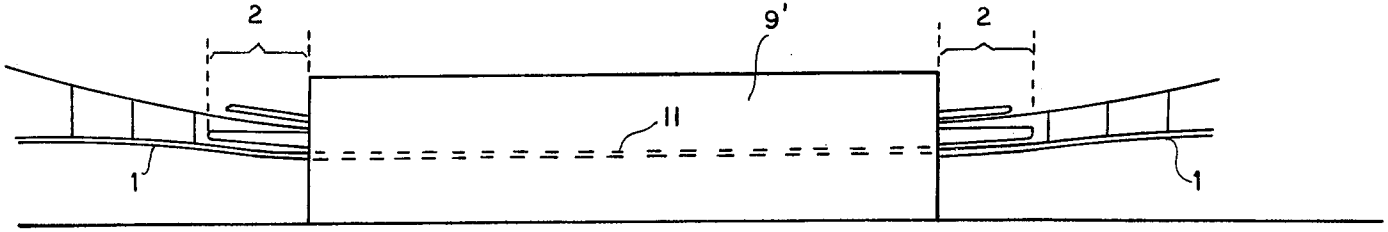

As shown in FIGS. 1 and 2 a suspension railway has a track 1 supported via horizontally spaced hangers 8 from a caternary suspension cable 3, here in fact formed by four parallel cables, passing over saddles 4 at the tops of towers 5 and either ending at a terminal station 9 as shown in FIG. 1 or passing through a way station 9' as shown in FIG. 2. The tower 7 is provided with a shaping or rounding beam 6 and the stations 9 and 9' are provided with a fixed track section 11, an entry or exit structure 2 that together give the suspended portion of the track 1 a downward concavity. Thus as a car 4 rides along the track 1 it will be displaced from the downwardly concave unloaded position to a substantially straight lower loaded position.

Figure 3:
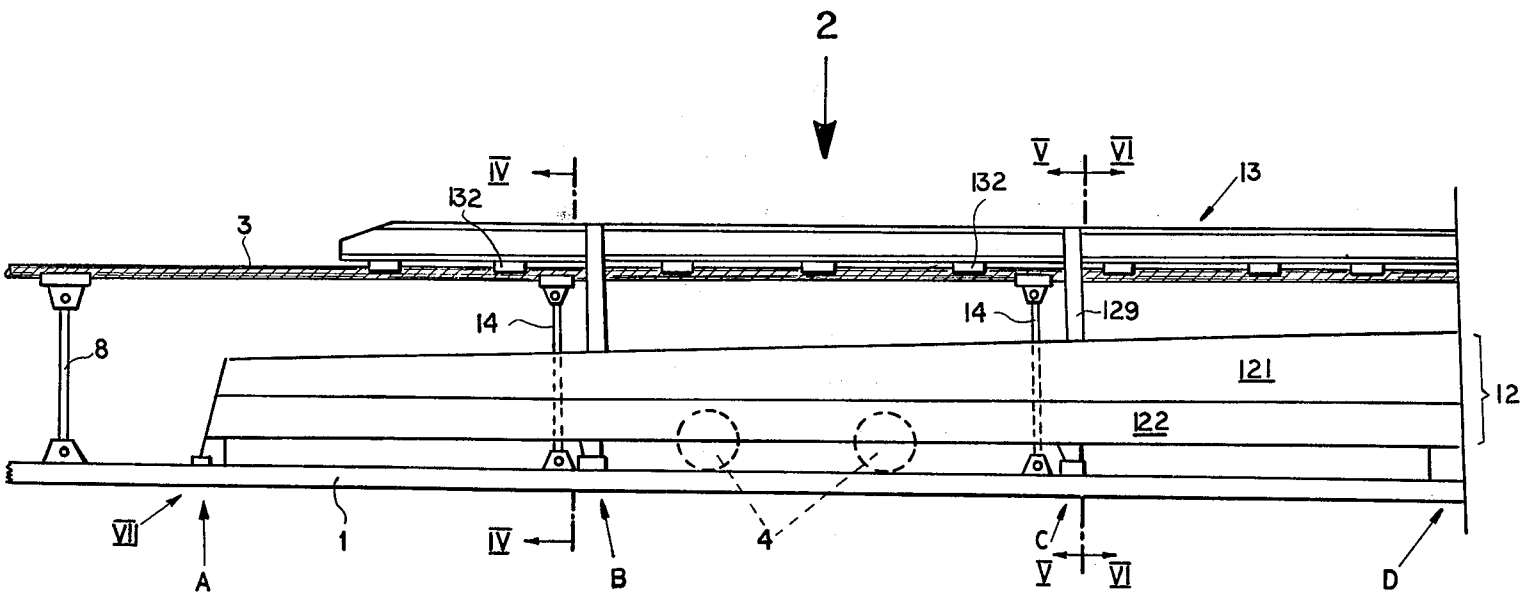
FIG. 3 is a large-scale side view of the station structure according to this invention.
Figure 4:
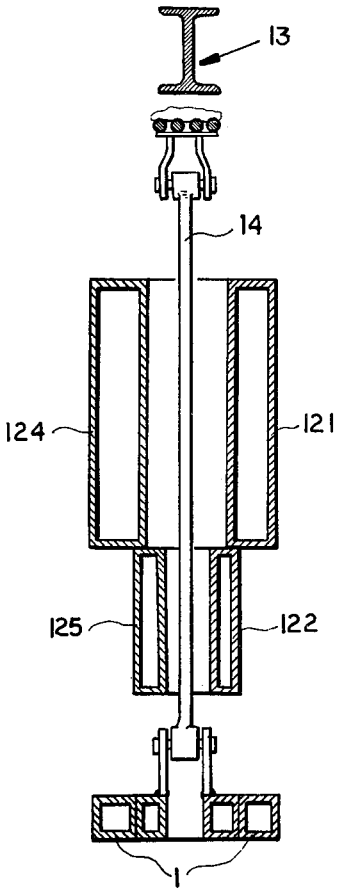
FIGS. 4, 5, and 6 are sections taken along lines IV—IV, V—V, and VI—VI, respectively, of FIG. 3.
Figure 5:
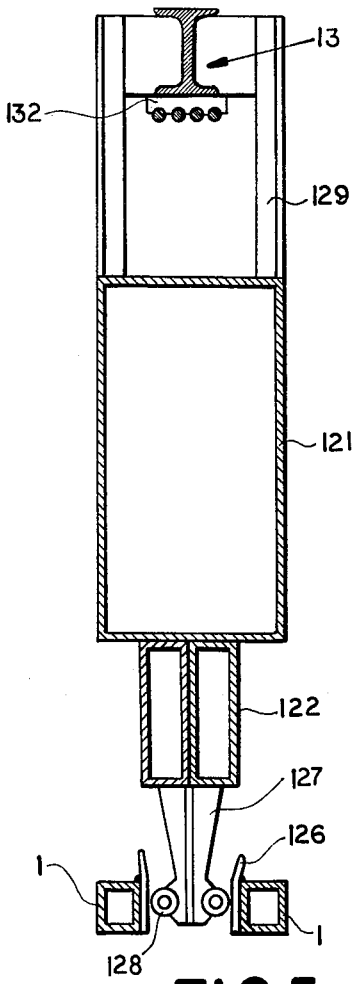
Figure 6:
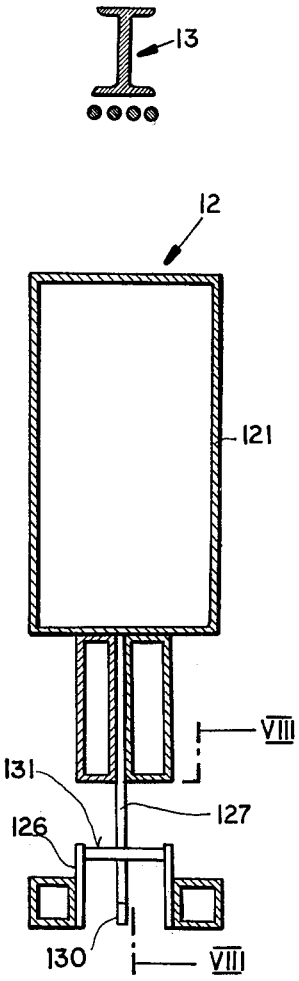

In order to insure a uniform transition from the deflectable suspended portion of the track 1 to the immovable portion 11, the structure 2 has as shown in FIG. 3 a main horizontal I-beam 13. The guide beam 12 has as shown in FIGS. 4–6 a horizontally extending rectangular-section lower portion 122 and a rectangular hollow upper section 121 which decreases in size away from the station 9 or 9'. These sections 121 and 122 are formed as shown in FIG. 4 with throughgoing respective holes 124 and 125 for hangers 14 identical to the hangers 8. The I-beam 13 carries holders 132 against which the cables 3 lie in the unloaded condition of the structure, but away from which these cables can pull when the structure is loaded down by the car 4. The beams 12 and 13 are secured vertically together by struts 129.

Figure 7:
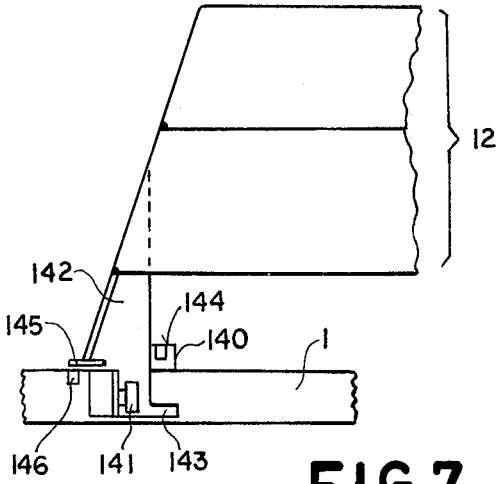
FIG. 7 is a large-scale sectional view of the area indicated at arrow VII in FIG. 3.
Figure 8:
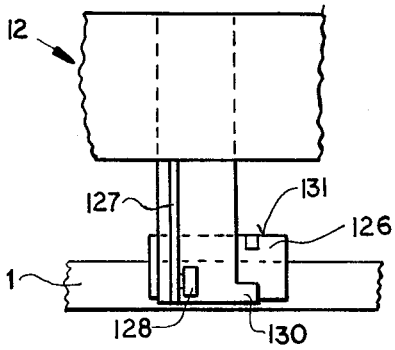
FIG. 8 is a section taken along line VIII in FIG. 6.

At its upstream end in the region indicated with arrow A in FIG. 3 the beam 12 is provided as shown in FIG. 7 with a downwardly extending plate 142 carrying a horizontally extending flange or guide surface 145 that can coact with the horizontal transverse strut or abutment 146 extending between the two square-section beams of the track 1. In the unloaded condition this abutment 146 bears vertically against the plate 145 to define the upper position for the track 1 and to impart the desired negative curvative or downward concavity to the suspended portion of the track 1. In addition and as also shown in FIG. 8 rollers 141 carried on a cross flange bear against the insides of the two beams forming the tracks 1 to prevent transverse horizontal displacement of the track 1 relative to the beam 12. Another cross-member 144 is provided on the plates 140 on the track 1 that can coact with an abutment 143 on the plate 142 to limit the downward travel of the track 1 relative to the beam 12.

Immediately downstream of the first hanger 14 passing through the holes 124 and 125 and immediately downstream of the second hanger 14 at locations B and C along the track 1 are provided further arrangements shown in FIGS. 5, 6, and 8. Here rollers 128 are carried on downwardly extending flanges 127 from the beam 12 and engage flanges 126 provided on the inner faces of the beams forming the track 1. The interaction of these rollers 128 and the flanges 126 prevents horizontal displacement of the track 1 perpendicular to its direction of elongation. Similarly a horizontal rod 131 welded across between the flanges 126 can come downwardly to rest on an abutment 130 projecting backwardly from the plate 127 to limit downward displacement of the track 1 relative to the beam 12. Such downward displacement is only limited beyond a predetermined range, however, as under normal circumstances the track 1 is not loaded so heavily by the car 4 that the abutments 143 and 144 at location A or 130 and 131 at locations B and C will engage each other.

At the downstream end of the structure 2 the track 1 becomes fixed at the section 11 and further displacement of this track 1 is impossible.

The system according to the instant invention therefore allows a smooth and gradual transition from the deflectable portion of the track to the stationary portion thereof. This transition is achieved without unduly straining any particular portion of the track, and will in fact be imperceptible to passengers inside the car 4. The rollers 4' (FIG. 3) of this car 4 will therefore be able to move at high speed along the track 1 both in the suspended and fixed portions thereof.

We claim:

1. In a suspended railway having
a substantially fixed tower;
a substantially fixed station;
a suspension cable slung between said tower and said station;
a plurality of horizontally spaced upright hangers depending from said cable;
a horizontally extending track having a suspended section secured in said station; and
a car travelable along said track, said track being vertically deflectable from an upper unloaded position into a lower loaded position as said car travels along it;
the improvement comprising a substantially rigid guide beam projecting from said station between said track and said cable toward said tower and having a lower guide surface bearing downwardly on said track in said unloaded position therof, whereby as said car approaches said fixed section of said track at said station said suspended section is pulled down from said guide beam.

2. The improvement defined in claim 1, further comprising a fixed horizontal guide surface above said guide beam and bearing downwardly on said cable in said unloaded position thereof.

3. The improvement defined in claim 2 wherein said track is downwardly concave between said tower and said beam in said unloaded position.

4. The improvement defined in claim 1, further comprising means limiting downward displacement of said track relative to said guide surface.

5. The improvement defined in claim 4 wherein said means includes a fixed stop mounted on said beam and engageable with said track after displacement thereof vertically downwardly away from said surface beyond a predetermined distance.

6. The improvement defined in claim 5 wherein, on loading of said track by said car and displacement into said loaded position of said track, same is displaced downwardly away from said surface through a distance shorter than said predetermined distance.

7. The improvement defined in claim 1 wherein said beam is formed with at least one throughgoing hole through which vertically extends a one of said hangers.

8. The improvement defined in claim 1, further comprising means for limiting horizontal displacement of said track relative to said beam in a direction transverse to the direction of elongation of said track.

9. The improvement defined in claim 8 wherein said means for limiting includes rollers operatively engageable between said beam and said track and rotatable about roller axes generally parallel to said track and said beam.

10. The improvement defined in claim 8, further comprising means limiting downward displacement of said track relative to said guide surface.

* * * * *